US008497806B2

(12) United States Patent
Lai et al.

(10) Patent No.: US 8,497,806 B2
(45) Date of Patent: Jul. 30, 2013

(54) MOBILE WIRELESS DEVICE WITH MULTI-BAND LOOP ANTENNA WITH ARMS DEFINING A SLOTTED OPENING AND RELATED METHODS

(75) Inventors: Chun Kit Lai, Sunrise, FL (US); Soo Liam Ool, Sunrise, FL (US); Qiwu Tan, Sunrise, FL (US)

(73) Assignee: Research In Motion Limited, Waterloo, Ontario (CA)

( * ) Notice: Subject to any disclaimer, the term of this patent is extended or adjusted under 35 U.S.C. 154(b) by 361 days.

(21) Appl. No.: 13/005,326

(22) Filed: Jan. 12, 2011

(65) Prior Publication Data

US 2012/0019421 A1 Jan. 26, 2012

Related U.S. Application Data

(60) Provisional application No. 61/367,083, filed on Jul. 23, 2010.

(51) Int. Cl.

| | |
|---|---|
| ***H01Q 1/24*** | (2006.01) |
| ***H01Q 1/00*** | (2006.01) |
| ***H01Q 1/38*** | (2006.01) |

(52) U.S. Cl.

USPC ..... 343/702; 343/729; 343/700 MS

(58) Field of Classification Search

None

See application file for complete search history.

(56) References Cited

U.S. PATENT DOCUMENTS

| | | | | |
|---|---|---|---|---|
| 6,664,931 | B1 | 12/2003 | Nguyen et al. | 343/767 |
| 6,717,551 | B1 | 4/2004 | Desclos et al. | 343/700 |
| 6,822,611 | B1 | 11/2004 | Kontogeorgakis et al. | 343/702 |
| 7,050,014 | B1 | 5/2006 | Chen et al. | 343/795 |
| 7,564,411 | B2 | 7/2009 | Piisila et al. | 343/702 |
| 7,626,551 | B2 | 12/2009 | Chien et al. | 343/700 |
| 7,671,804 | B2 * | 3/2010 | Zhang et al. | 343/700 MS |
| 2005/0151689 | A1 * | 7/2005 | Vesterinen | 343/702 |
| 2005/0270242 | A1 | 12/2005 | Qi et al. | 343/702 |
| 2005/0280587 | A1 * | 12/2005 | Svigelj et al. | 343/702 |
| 2008/0231530 | A1 | 9/2008 | Rao et al. | 343/767 |
| 2009/0073048 | A1 | 3/2009 | Kim | 343/700 MS |
| 2009/0124215 | A1 | 5/2009 | Nysen | 455/90.1 |
| 2009/0179801 | A1 | 7/2009 | Tsai et al. | 343/700 MS |
| 2009/0201209 | A1 * | 8/2009 | Boyle | 343/702 |
| 2012/0032857 | A1 * | 2/2012 | Lai et al. | 343/700 MS |
| 2012/0032863 | A1 * | 2/2012 | Lai et al. | 343/767 |
| 2012/0188141 | A1 * | 7/2012 | Islam | 343/860 |

FOREIGN PATENT DOCUMENTS

| | | |
|---|---|---|
| EP | 2026407 | 2/2009 |
| WO | WO00/03452 | 1/2000 |
| WO | WO2005/043674 | 5/2005 |
| WO | WO2008/122112 | 10/2008 |

* cited by examiner

*Primary Examiner* — Trinh Dinh

(74) *Attorney, Agent, or Firm* — Allen, Dyer, Doppelt, Milbrath & Gilchrist, P.A.

(57) ABSTRACT

A mobile wireless communications device may include a housing, a printed circuit board (PCB) carried by the housing. The device may also include an antenna coupled to wireless transceiver circuitry carried by the PCB. The antenna may include first and second feed legs extending upwardly from the PCB, a loop conductor spaced above the PCB and having a gap therein defining first and second ends, and a first conductor arm spaced above the PCB and extending between the first feed leg and the first end. The antenna may further include a second conductor arm spaced above the PCB and having a proximal portion between the second feed leg and the second end, and having a distal portion extending outwardly from the second feed leg. The first conductor arm and the proximal portion may define a slotted opening into an interior of the loop conductor.

23 Claims, 9 Drawing Sheets

MOBILE WIRELESS DEVICE WITH MULTI-BAND LOOP ANTENNA WITH ARMS DEFINING A SLOTTED OPENING AND RELATED METHODS

RELATED APPLICATION

The present application is based upon previously filed copending provisional application Ser. No. 61/367,083, filed Jul. 23, 2010, the entire subject matter of which is incorporated by reference in its entirety.

TECHNICAL FIELD

The present disclosure generally relates to the field of wireless communications systems, and, more particularly, to mobile wireless communications devices and related methods.

BACKGROUND

Mobile wireless communications systems continue to grow in popularity and have become an integral part of both personal and business communications. For example, cellular telephones allow users to place and receive voice calls almost anywhere they travel. Moreover, as cellular telephone technology has increased, so too has the functionality of cellular devices and the different types of devices available to users. For example, many cellular devices now incorporate personal digital assistant (PDA) features such as calendars, address books, task lists, etc. Moreover, such multi-function devices may also allow users to wirelessly send and receive electronic mail (email) messages and access the Internet via a cellular network and/or a wireless local area network (WLAN), for example.

Even so, as the functionality of cellular communications devices continues to increase, so too does the demand for smaller devices which are easier and more convenient for users to carry. One challenge this poses for cellular device manufacturers is designing antennas that provide desired operating characteristics within the relatively limited amount of space available for antennas.

DETAILED DESCRIPTION

Figure 1:
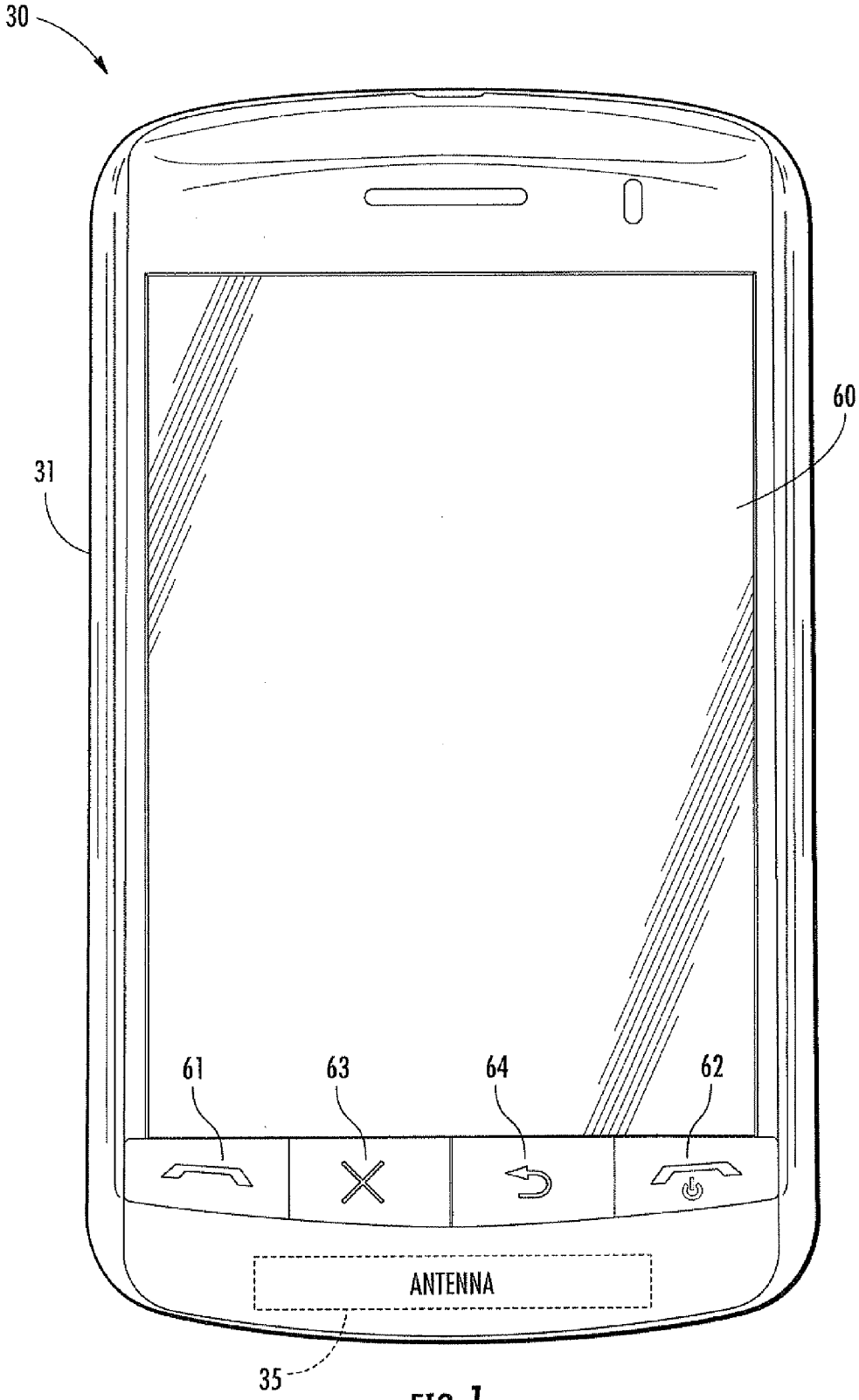
FIG. 1 is a front view of a mobile wireless communications device including an antenna in accordance with one exemplary aspect.

The present description is made with reference to the accompanying drawings, in which various embodiments are shown. However, many different embodiments may be used, and thus the description should not be construed as limited to the embodiments set forth herein. Rather, these embodiments are provided so that this disclosure will be thorough and complete. Like numbers refer to like elements throughout and prime notation is used to indicate similar elements in alternative embodiments.

In accordance with one exemplary aspect, a mobile wireless communications device may include a portable housing, a printed circuit board (PCB) carried by the portable housing, and wireless transceiver circuitry carried by the PCB. The mobile wireless communications device may also include an antenna coupled to the wireless transceiver circuitry. The antenna may include first and second feed legs extending upwardly from the PCB, a loop conductor spaced above the PCB and having a gap therein defining first and second ends, and a first conductor arm spaced above the PCB and extending between the first feed leg and the first end of the loop conductor, for example. The antenna may also include a second conductor arm spaced above the PCB and having a proximal portion extending between the second feed leg and the second end of the loop conductor, and having a distal portion extending outwardly from the second feed leg. The first conductor arm and the proximal portion of the second conductor arm may define a slotted opening into an interior of the loop conductor. Accordingly, the antenna may provide increased multi-band performance.

The second conductor arm may have an elongated linear shape. The second conductor arm may have an L-shape, for example. Alternatively, the second conductor may have a U-shape. The second conductor may define a second slotted opening between the loop conductor and the second conductor arm.

The first conductor arm may have an elongated linear shape. The loop conductor may also have a U-shape, for example. The PCB may include a ground plane conductor.

A method aspect is directed to a method of making the antenna for a mobile wireless communications device including a portable housing, a printed circuit board (PCB) carried by the portable housing, and wireless transceiver circuitry carried by the PCB. The method may include positioning first and second feed legs to extend upwardly from the PCB, and spacing a loop conductor above the PCB, the loop conductor having a gap therein defining first and second ends, for example. The method may also include spacing a first conductor arm above the PCB and to extend between the first feed leg and the first end of the loop conductor. The method may further include spacing a second conductor arm above the PCB, for example. The second conductor arm may have a proximal portion to extend between the second feed leg and the second end of the loop conductor, and may have a distal portion to extend outwardly from the second feed leg. The first conductor arm and the proximal portion of the second conductor arm may define a slotted opening into an interior of the loop conductor, for example.

Figure 2:
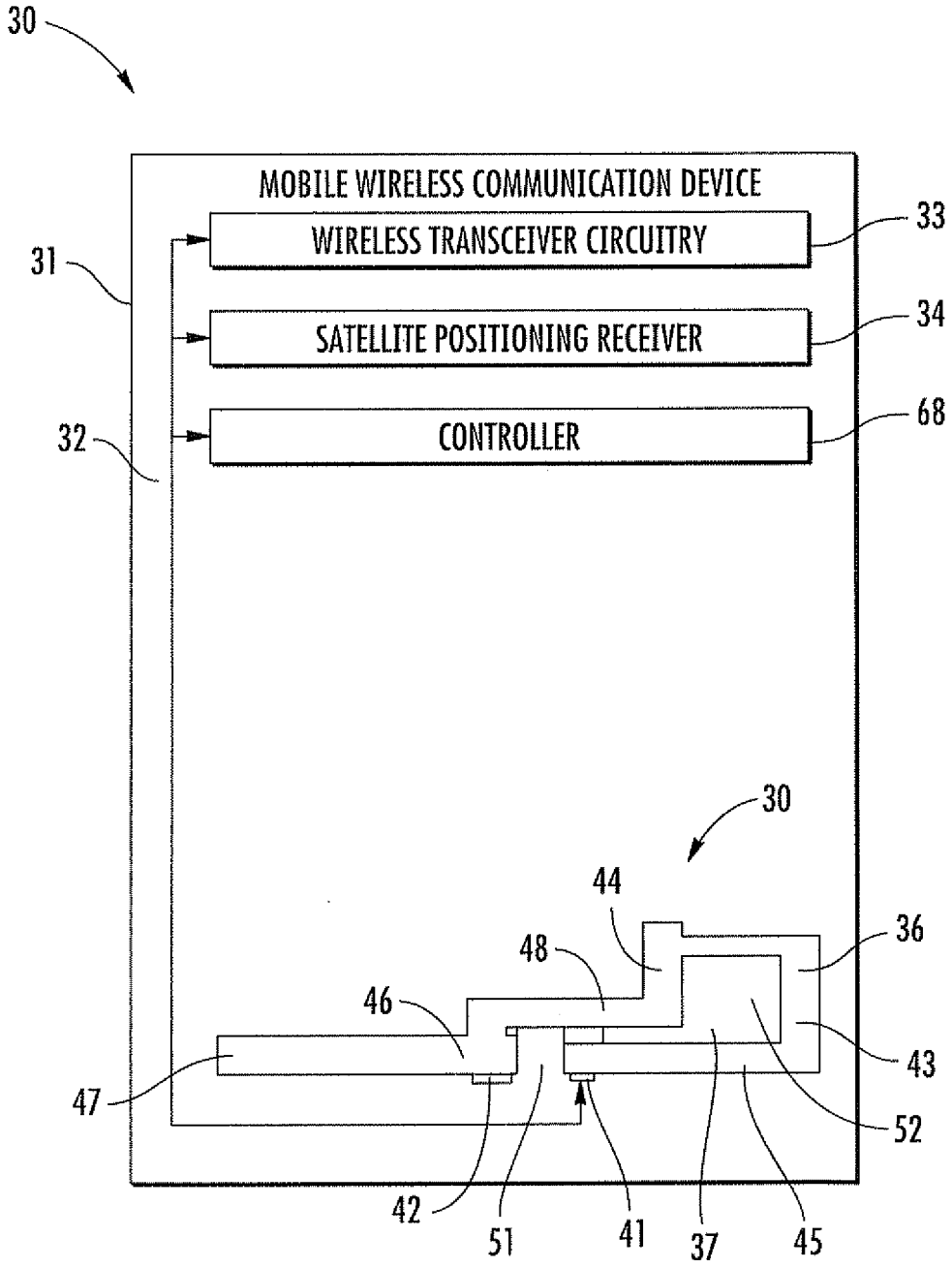
FIG. 2 is a schematic diagram of the printed circuit board (PCB) and the antenna of the device of FIG. 1.
Figure 3:
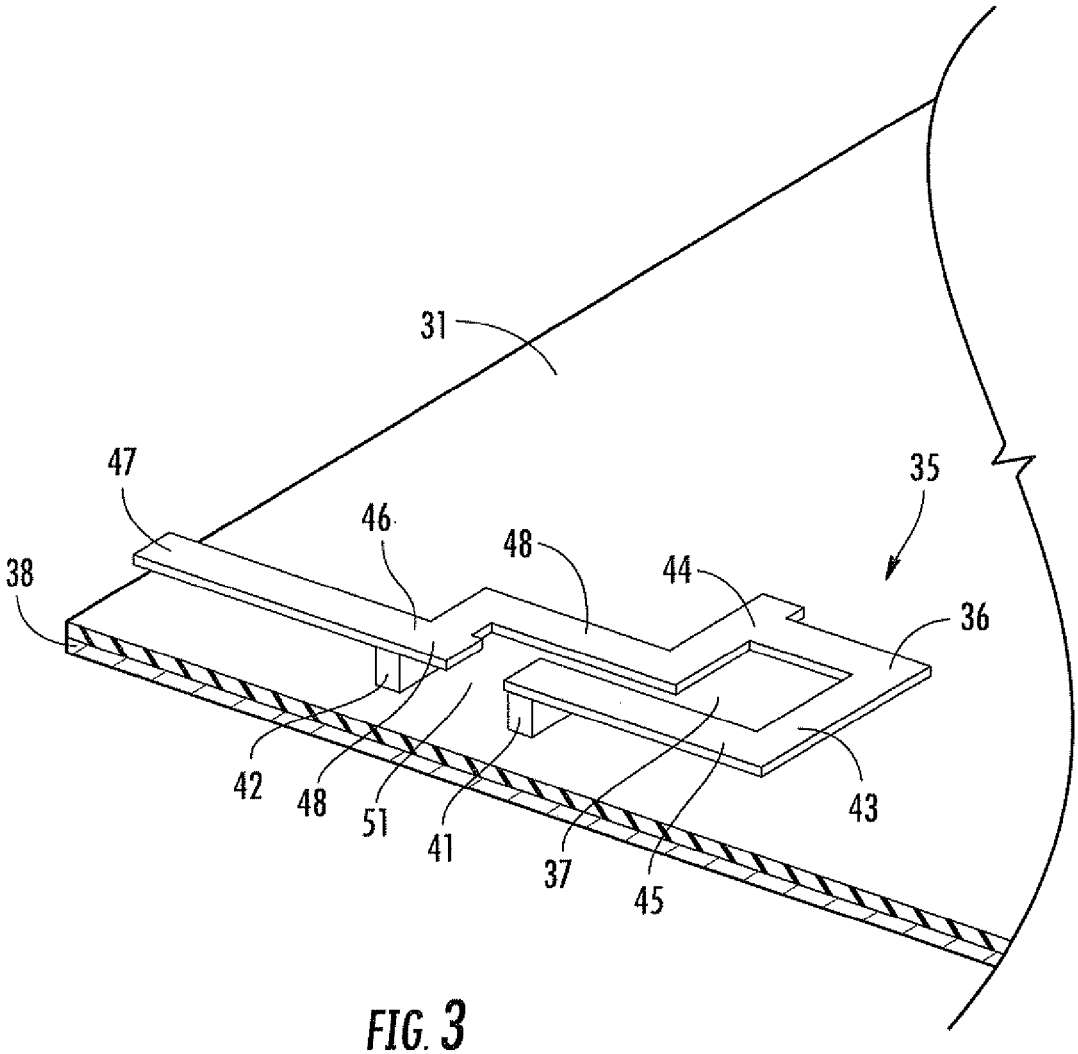
FIG. 3 is a perspective view of the antenna and a portion of the PCB of FIG. 1.

Referring initially to FIGS. 1-3, a mobile wireless communications device 30 illustratively includes a portable housing 31, a printed circuit board (PCB) 32 carried by the portable housing, and wireless transceiver circuitry 33 carried by the portable housing. In some embodiments, not shown, the PCB 32 may be replaced by or used in conjunction with a metal chassis or other substrate. The PCB 32 also includes a conductive layer defining a ground plane conductor 38.

A satellite positioning signal receiver 34 is also carried by the portable housing 31. The satellite positioning signal receiver 34 may be a Global Positioning System (GPS) satellite receiver, for example.

The exemplary device 30 further illustratively includes a display 60 and a plurality of control keys including an "off hook" (i.e., initiate phone call) key 61, an "on hook" (i.e., discontinue phone call) key 62, a menu key 63, and a return or escape key 64. Operation of the various device components and input keys, etc., will be described further below with reference to FIG. 9.

The device 30 further illustratively includes an antenna 35 coupled to the wireless transceiver circuitry 33. The antenna 35 includes first and second feed legs 41, 42 extending upwardly from the PCB 32.

The antenna 35 includes a loop conductor 36 spaced above PCB 32. The loop conductor 36 illustratively has a gap 37 therein defining first and second ends 43, 44.

The antenna 35 includes a first conductor arm 45 spaced above the PCB 32 and extending between the first feed leg 41 and the first end 43 of the loop conductor 36. The first conductor arm 45 illustratively has an elongated linear shape. Of course, the first conductor arm 45 may be another shape, as will be appreciated by those skilled in the art.

The antenna 35 also includes a second conductor 46 arm spaced above the PCB 32. The second conductor arm 46 illustratively has an elongated linear shape. The second conductor arm 46 has a proximal portion 48 extending between the second feed leg 42 and the second end 44 of the loop conductor 36. The second conductor arm 46 also has a distal portion 47 extending outwardly from the second feed leg 42.

The first conductor arm 45 and the proximal portion 48 of the second conductor arm 46 define a slotted opening 51 into an interior 52 of the loop conductor 36. The slotted opening 51 illustratively is an L-shaped slotted opening. The L-shaped slotted opening includes a relatively long and narrow slotted opening that opens into a larger area slotted opening in the interior 52 of the loop conductor 36.

The loop conductor 36, first conductor arm 45, and the second conductor arm 46 are advantageously spaced by the first and second feed legs 41, 42, above the PCB 32. Additional supporting elements may be used to keep the loop conductor 36, first conductor arm 45, and the second conductor arm 46 in spaced relation above the PCB 32. Moreover, a dielectric body (not shown) may be between the antenna 35 and the PCB 32.

A controller 68 or processor may also be carried by the PCB 32. The controller 68 may cooperate with the other components, for example, the antenna 35, the satellite positioning signal receiver 34, and the wireless transceiver circuitry 33 to coordinate and control operations of the mobile wireless communications device 30. Operations may include mobile voice and data operations, including email and Internet data.

Figure 4:
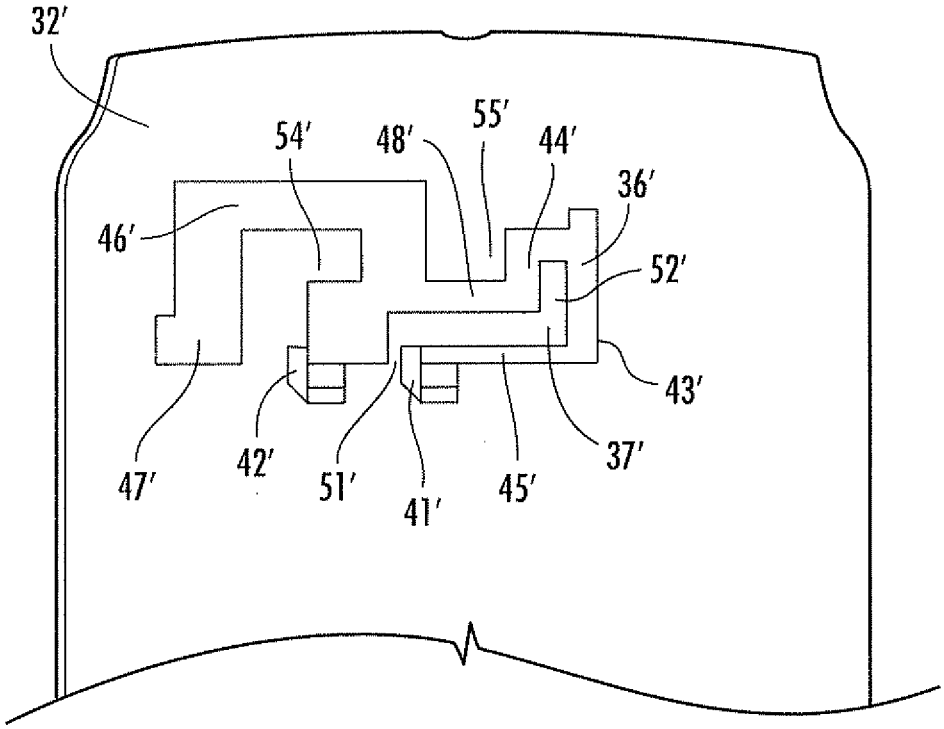
FIG. 4 is a schematic diagram of a portion of a PCB and an antenna according to another exemplary aspect.

Referring now to FIG. 4, in another exemplary embodiment of the antenna 35', the second conductor arm 46' is U-shaped. More particularly, the distal portion 47' is U-shaped. The second conductor arm 46' has an increased width dimension as compared to the second conductor arm of the antenna 30 illustrated in FIGS. 2 and 3, for example. Illustratively, the U-shape of the distal portion 47' defines a second slotted opening 54'. The proximal portion 48' of the second conductor arm 46' defines a third slotted opening 55' with the second end 44' of the loop conductor 36'.

The first conductor arm 45' has an elongated linear shape. The slotted opening 51' is L-shaped and maintains a relatively same width as it extends into the interior 52' of the loop conductor 36'.

Figure 5:
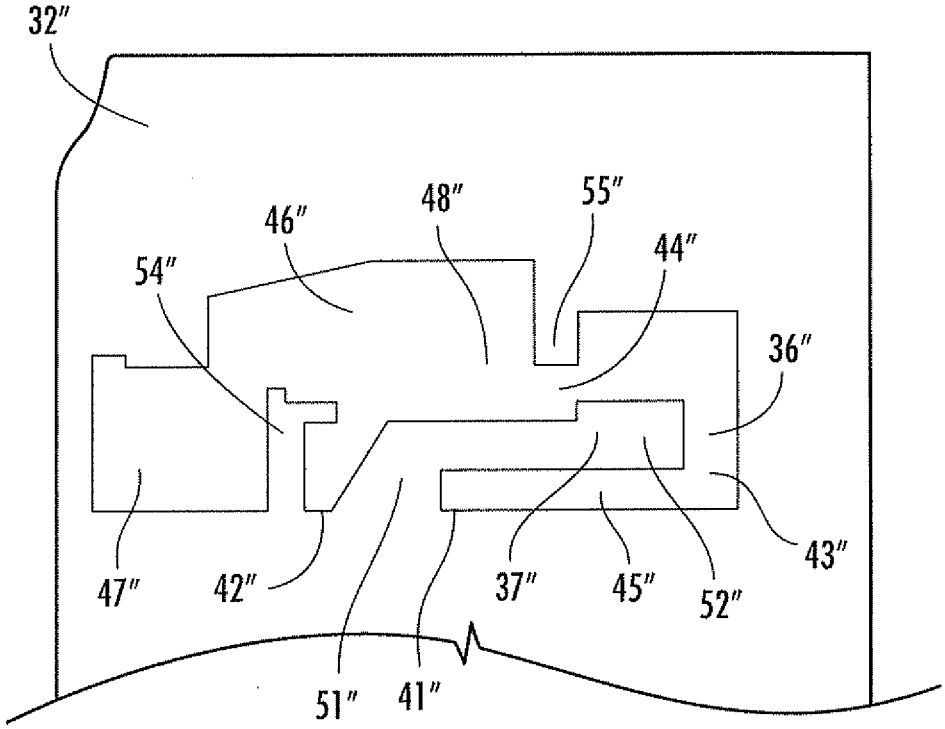
FIG. 5 is a schematic diagram of a portion of a PCB and an antenna according to another exemplary aspect.

Referring now to FIG. 5, in another exemplary embodiment of the antenna 35", the second conductor arm 46" is L-shaped. More particularly, the distal portion 47" is L-shaped. The second conductor arm 46" illustratively has broadened dimensions in both length and width. Illustratively, the L-shape of the distal portion 47" defines a second slotted opening 54". The second conductor arm 46", and more particularly, the proximal portion 48" also defines a third slotted opening 55" with adjacent portions of the second end 44" of the loop conductor 36".

The first conductor arm 45" has an elongated linear shape. The slotted opening 51" is a relatively straight slotted opening and includes an increased width portion adjacent the second end 44" of the loop conductor 36".

Figure 6:
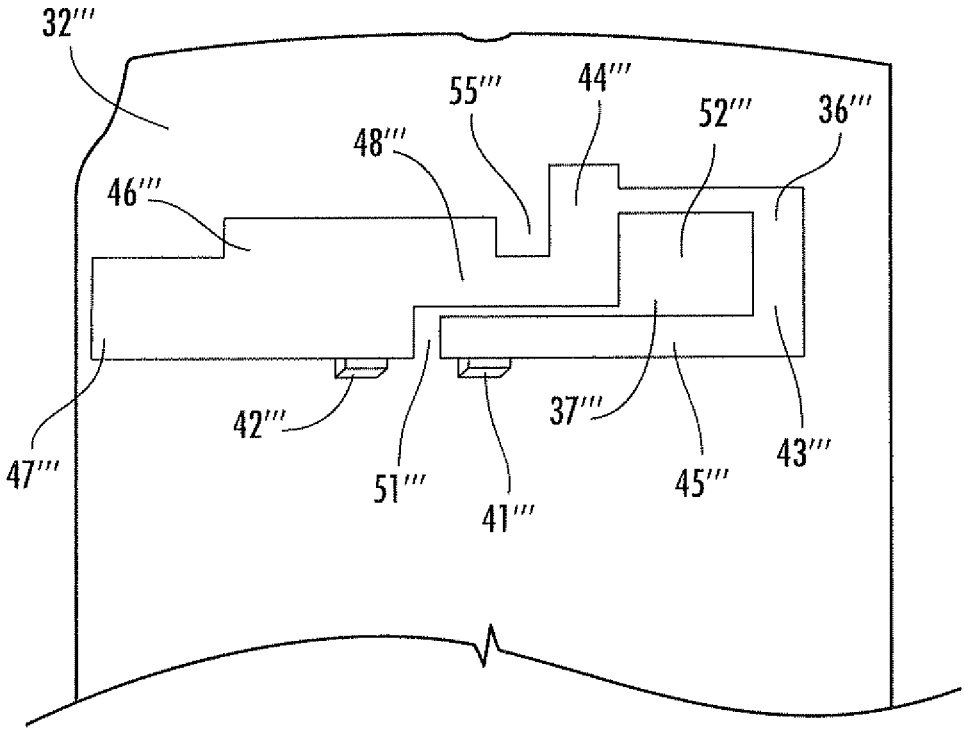
FIG. 6 is a schematic diagram of a portion of a PCB and an antenna according to another exemplary aspect.

Referring now to FIG. 6, in another exemplary embodiment of the antenna 35''', the second conductor arm 46''' has an elongated linear shape. The second conductor arm 46''' illustratively is straightened with respect to the exemplary embodiments illustrated in FIGS. 4 and 5, and has broadened dimensions in width with respect to the exemplary embodiment illustrated in FIGS. 2 and 3. The proximal end 48''' of the second conductor arm 46''' also defines a third slotted opening 55''' with adjacent portions of the second end 44''' of the loop conductor 36'''.

The first conductor arm 45''' has an elongated linear shape. The slotted opening 51''' is L-shaped and includes a relatively long and narrow slotted opening that opens into a larger area slotted opening in the interior 52''' of the loop conductor 36'''.

Figure 7:
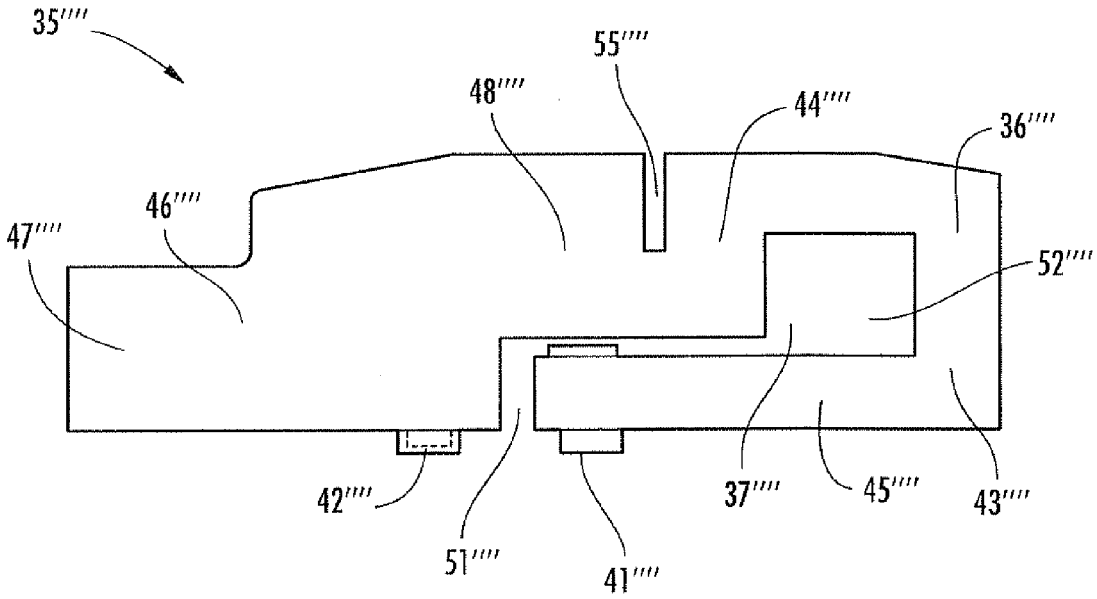
FIG. 7 is a schematic diagram of an antenna according to another exemplary aspect.

Referring now to FIG. 7, in another exemplary embodiment of the antenna 35'''', the second conductor arm 46'''' has an elongated linear shape. The second conductor arm 46'''' illustratively is straightened with respect to the exemplary embodiments illustrated in FIGS. 4 and 5, and has broadened dimensions in width with respect to the exemplary embodiment illustrated in FIGS. 2 and 3. The proximal end 48'''' of the second conductor arm 46'''' also defines a third slotted opening 55'''' with the second end 44'''' of the loop conductor 36''''.

The first conductor arm 45'''' has an elongated linear shape. The slotted opening 51'''' is L-shaped and includes a relatively long and narrow slotted opening that opens into a larger area slotted opening in the interior 52'''' of the loop conductor 36''''.

Figure 8A:
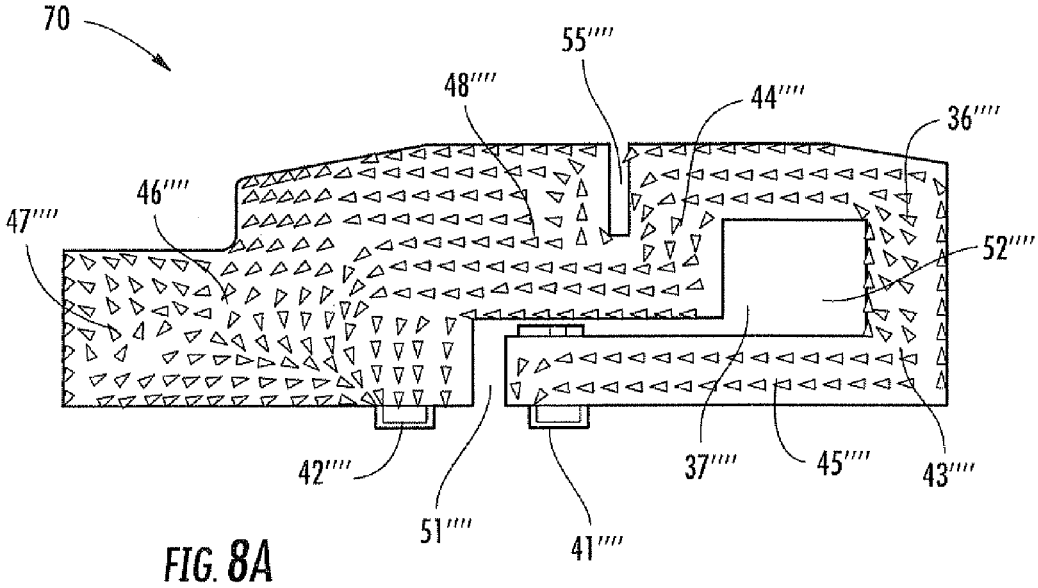
FIGS. 8*a* and 8*b* are current graphs of the antenna of FIG. 7.
Figure 8B:
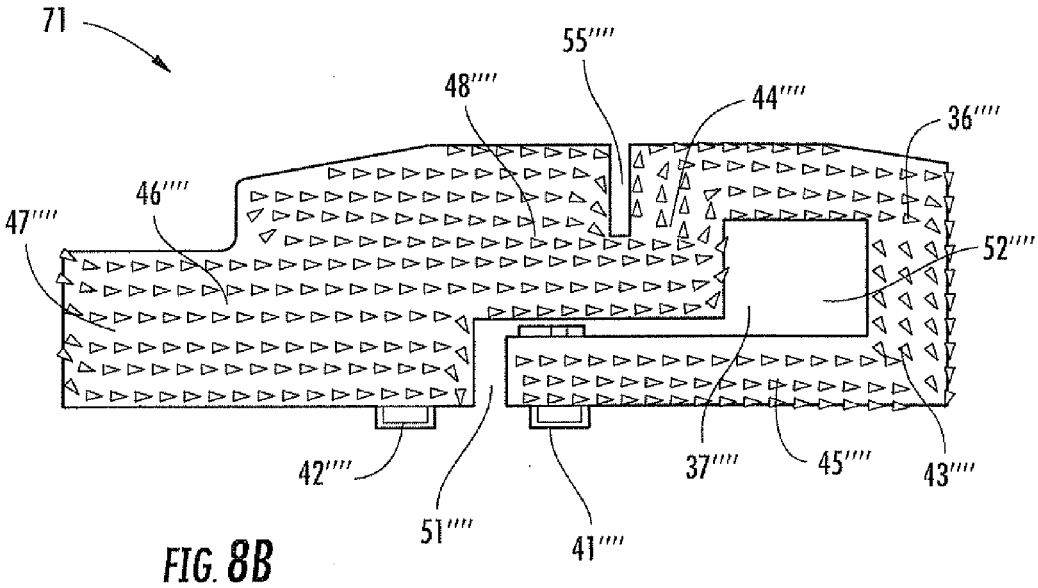

Referring now additionally to the graphs in FIGS. 8*a* and 8*b*, operation of the antenna 35'''' in FIG. 7 is described with respect to the current maps 70, 71. As will be appreciated by those skilled in the art, the antenna 35'''' operates in two modes, a common mode (FIG. 8*a*) and a differential mode (FIG. 8*b*). The length of the first and second conductor arms 45'''', 46'''' form a differential pair of a half wavelength antenna. The perimeter length of the slot 51'''', in other words, the length of the loop, provides the main excitation to the antenna 35''''. Surface current is illustratively in phase in the differential mode (FIG. 8*b*).

In the common mode (FIG. 8*a*), the current concentrates on the loop conductor 36''''. More particularly, the current concentrates on the outer perimeter of the loop conductor 36'''' and over the second conductor arm 46''''. The current on the first and second conductor arms 45'''', 46'''' are illustratively out of phase.

The embodiments of the antenna 35 described herein, as a dual-band antenna, advantageously operate in frequency bands covering both Global Positioning System (GPS) frequencies (1.575 GHz) and Wireless Local Area Network (WLAN) frequencies (2.45 GHz). In the WLAN frequency band, the antenna 35 operates in the differential mode. As will be appreciated by those skilled in the art, operation in the differential mode is self-complimentary, similar to most half wavelength antennas, while also being driven by a quarter wavelength slot. Thus, the antenna 35 has a relatively high efficiency, for example, about 45% for the mobile wireless communications device 30.

At lower frequencies, for example, in the GPS frequency band, the antenna 35 operates in the common mode. For example, at lower frequencies, the antenna 35 operates similar to a folded inverted F antenna (PIFA). As will be appreciated by those skilled in the art, the antenna 35 advantageously has improved performance and reduced impact from proximity to the ground plane in the differential mode.

Additionally, while different embodiments of the antenna 35 have been described herein with respect to shape, the antenna 35 may be shaped to fit a housing. As will be appreciated by those skilled in the art, the antenna 35 may be sized, for example, to include curved portions, for fitment into different sized and shaped housings. For example, the second conductor arm 46 may include a curved surface opposite the second feed leg 42 along the lines illustrated in FIG. 7, and while the example embodiments illustrate the antenna as a planar antenna, the antenna 35 may be non-planar.

A method aspect is directed to a method of making the antenna 35 for a mobile wireless communications device 30 including a portable housing 31, a printed circuit board (PCB) 32 carried by the portable housing, and wireless transceiver circuitry 33 carried by the PCB. The method includes positioning first and second feed legs 41, 42 to extend upwardly from the PCB 32, and spacing a loop conductor 36 above the PCB. The loop conductor 36 has a gap 37 therein defining first and second ends 43, 44.

The method also includes spacing a first conductor arm 45 above the PCB 32 and to extend between the first feed leg 41 and the first end 43 of the loop conductor 36. The method further includes spacing a second conductor arm 46 above the PCB 32. The second conductor arm 46 has a proximal portion 48 to extend between the second feed leg 42 and the second end 44 of the loop conductor 36, and has a distal portion 47 to extend outwardly from the second feed leg. The first conductor arm 45 and the proximal portion 48 of the second conductor arm 46 define a slotted opening 51 into an interior of the loop conductor 36.

Exemplary components that may be used in various embodiments of the above-described mobile wireless communications device are now described with reference to an exemplary mobile wireless communications device 1000 shown in FIG. 9. The device 1000 illustratively includes a housing 1200, a keypad 1400 and an output device 1600. The output device shown is a display 1600, which may comprise a full graphic LCD. In some embodiments, display 1600 may comprise a touch-sensitive input and output device. Other types of output devices may alternatively be utilized. A processing device 1800 is contained within the housing 1200 and is coupled between the keypad 1400 and the display 1600. The processing device 1800 controls the operation of the display 1600, as well as the overall operation of the mobile device 1000, in response to actuation of keys on the keypad 1400 by the user. In some embodiments, keypad 1400 may comprise a physical keypad or a virtual keypad (e.g., using a touch-sensitive interface) or both.

The housing 1200 may be elongated vertically, or may take on other sizes and shapes (including clamshell housing structures, for example). The keypad 1400 may include a mode selection key, or other hardware or software for switching between text entry and telephony entry.

Figure 9:
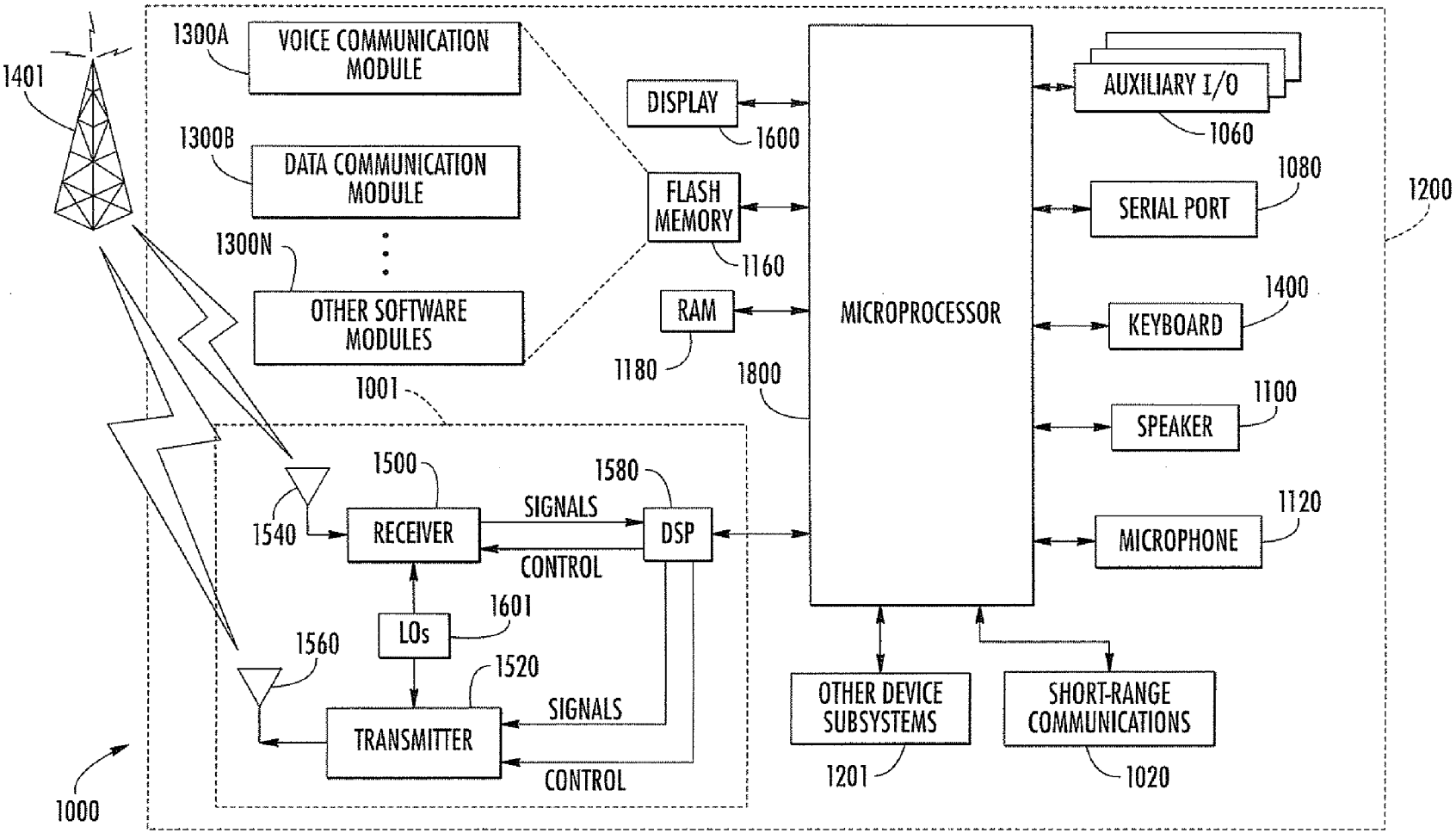
FIG. 9 is a schematic block diagram illustrating additional components that may be included in the mobile wireless communications device of FIG. 1.

In addition to the processing device 1800, other parts of the mobile device 1000 are shown schematically in FIG. 9. These include a communications subsystem 1001; a short-range communications subsystem 1020; the keypad 1400 and the display 1600, along with other input/output devices 1060, 1080, 1100 and 1120; as well as memory devices 1160, 1180 and various other device subsystems 1201. The mobile device 1000 may comprise a two-way RF communications device having voice and data communications capabilities. In addition, the mobile device 1000 may have the capability to communicate with other computer systems via the Internet.

Operating system software executed by the processing device 1800 may be stored in a persistent store, such as the flash memory 1160, but may be stored in other types of memory devices, such as a read only memory (ROM) or similar storage element. In addition, system software, specific device applications, or parts thereof, may be temporarily loaded into a volatile store, such as the random access memory (RAM) 1180. Communications signals received by the mobile device may also be stored in the RAM 1180.

The processing device 1800, in addition to its operating system functions, enables execution of software applications or modules 1300A-1300N on the device 1000, such as software modules for performing various steps or operations. A predetermined set of applications that control basic device operations, such as data and voice communications 1300A and 1300B, may be installed on the device 1000 during manufacture. In addition, a personal information manager (PIM) application may be installed during manufacture. The PIM may be capable of organizing and managing data items, such as e-mail, calendar events, voice mails, appointments, and task items. The PIM application may also be capable of sending and receiving data items via a wireless network 1401. The PIM data items may be seamlessly integrated, synchronized and updated via the wireless network 1401 with the device user's corresponding data items stored or associated with a host computer system.

Communication functions, including data and voice communications, are performed through the communications subsystem 1001, and possibly through the short-range communications subsystem. The communications subsystem 1001 includes a receiver 1500, a transmitter 1520, and one or more antennas 1540 and 1560. In addition, the communications subsystem 1001 also includes a processing module, such as a digital signal processor (DSP) 1580, and local oscillators (LOs) 1601. The specific design and implementation of the communications subsystem 1001 is dependent upon the communications network in which the mobile device 1000 is intended to operate. For example, a mobile device 1000 may include a communications subsystem 1001 designed to operate with the Mobitex™, Data TAC™ or General Packet Radio Service (GPRS) mobile data communications networks, and also designed to operate with any of a variety of voice communications networks, such as AMPS, TDMA, CDMA, WCDMA, PCS, GSM, EDGE, etc. Other types of data and voice networks, both separate and integrated, may also be utilized with the mobile device 1000. The mobile device 1000 may also be compliant with other communications standards such as GSM, 3G, UMTS, 4G, etc.

Network access requirements vary depending upon the type of communication system. For example, in the Mobitex and DataTAC networks, mobile devices are registered on the network using a unique personal identification number or PIN associated with each device. In GPRS networks, however, network access is associated with a subscriber or user of a device. A GPRS device therefore utilizes a subscriber identity module, commonly referred to as a SIM card, in order to operate on a GPRS network.

When required network registration or activation procedures have been completed, the mobile device 1000 may send and receive communications signals over the communication network 1401. Signals received from the communications network 1401 by the antenna 1540 are routed to the receiver 1500, which provides for signal amplification, frequency down conversion, filtering, channel selection, etc., and may also provide analog to digital conversion. Analog-to-digital conversion of the received signal allows the DSP 1580 to perform more complex communications functions, such as demodulation and decoding. In a similar manner, signals to be transmitted to the network 1401 are processed (e.g. modulated and encoded) by the DSP 1580 and are then provided to the transmitter 1520 for digital to analog conversion, frequency up conversion, filtering, amplification and transmission to the communication network 1401 (or networks) via the antenna 1560.

In addition to processing communications signals, the DSP 1580 provides for control of the receiver 1500 and the transmitter 1520. For example, gains applied to communications signals in the receiver 1500 and transmitter 1520 may be adaptively controlled through automatic gain control algorithms implemented in the DSP 1580.

In a data communications mode, a received signal, such as a text message or web page download, is processed by the communications subsystem 1001 and is input to the processing device 1800. The received signal is then further processed by the processing device 1800 for an output to the display 1600, or alternatively to some other auxiliary I/O device 1060. A device user may also compose data items, such as e-mail messages, using the keypad 1400 and/or some other auxiliary I/O device 1060, such as a touchpad, a rocker switch, a thumb-wheel, or some other type of input device. The composed data items may then be transmitted over the communications network 1401 via the communications subsystem 1001.

In a voice communications mode, overall operation of the device is substantially similar to the data communications mode, except that received signals are output to a speaker 1100, and signals for transmission are generated by a microphone 1120. Alternative voice or audio I/O subsystems, such as a voice message recording subsystem, may also be implemented on the device 1000. In addition, the display 1600 may also be utilized in voice communications mode, for example to display the identity of a calling party, the duration of a voice call, or other voice call related information.

The short-range communications subsystem enables communication between the mobile device 1000 and other proximate systems or devices, which need not necessarily be similar devices. For example, the short-range communications subsystem may include an infrared device and associated circuits and components, or a Bluetooth™ communications module to provide for communication with similarly-enabled systems and devices.

Many modifications and other embodiments will come to the mind of one skilled in the art having the benefit of the teachings presented in the foregoing descriptions and the associated drawings. Therefore, it is understood that the disclosure is not to be limited to the specific embodiments disclosed, and that modifications and embodiments are intended to be included.

That which is claimed is:

1. A mobile wireless communications device comprising:
- a portable housing;
- a printed circuit board (PCB) carried by said portable housing;
- wireless transceiver circuitry carried by said PCB;
- an antenna coupled to said wireless transceiver circuitry and comprising
  - first and second feed legs extending upwardly from said PCB,
  - a loop conductor spaced above said PCB and having a gap therein defining first and second ends,
  - a first conductor arm spaced above said PCB and extending between said first feed leg and the first end of said loop conductor, and
  - a second conductor arm spaced above said PCB and having a proximal portion extending between said second feed leg and the second end of said loop conductor, and having a distal portion extending outwardly from the second feed leg,
  - said first conductor arm and the proximal portion of said second conductor arm defining a slotted opening into an interior of said loop conductor.

2. The mobile wireless communications device according to claim 1, wherein said second conductor arm has an elongated linear shape.

3. The mobile wireless communications device according to claim 1, wherein said second conductor arm has an L-shape.

4. The mobile wireless communications device according to claim 1, wherein said second conductor has U-shape.

5. The mobile wireless communications device according to claim 1, wherein said second conductor defines a second slotted opening between said loop conductor and said second conductor arm.

6. The mobile wireless communications device according to claim 1, wherein said first conductor arm has an elongated linear shape.

7. The mobile wireless communications device according to claim 1, wherein said loop conductor has a U-shape.

8. The mobile wireless communications device according to claim 1, wherein said PCB comprises a ground plane conductor.

9. An antenna for a mobile wireless communications device comprising a portable housing, a printed circuit board (PCB) carried by the portable housing, and wireless transceiver circuitry carried by the PCB, the antenna comprising:
- first and second feed legs to be coupled to the wireless transceiver circuitry and extend upwardly from the PCB;
- a loop conductor to be spaced above the PCB and having a gap therein defining first and second ends;
- a first conductor arm to be spaced above the PCB and extending between said first feed leg and the first end of said loop conductor; and
- a second conductor arm to be spaced above the PCB and having a proximal portion extending between said second feed leg and the second end of said loop conductor, and having a distal portion extending outwardly from the second feed leg;
- said first conductor arm and the proximal portion of said second conductor arm defining a slotted opening into an interior of said loop conductor.

10. The antenna according to claim 9, wherein said second conductor arm has an elongated linear shape.

11. The antenna according to claim 9, wherein said second conductor arm has an L-shape.

12. The antenna according to claim 9, wherein said second conductor has U-shape.

13. The antenna according to claim 9, wherein said second conductor defines a second slotted opening between said loop conductor and said second conductor arm.

14. The antenna according to claim 9, wherein said first conductor arm has an elongated linear shape.

15. The antenna according to claim 9, wherein said loop conductor has a U-shape.

16. A method of making an antenna for a mobile wireless communications device comprising a portable housing, a printed circuit board (PCB) carried by the portable housing, and wireless transceiver circuitry carried by the PCB, the method comprising:

positioning first and second feed legs to extend upwardly from the PCB;

spacing a loop conductor above the PCB, the loop conductor having a gap therein defining first and second ends;

spacing a first conductor arm above the PCB and to extend between the first feed leg and the first end of the loop conductor; and spacing a second conductor arm above the PCB, the second conductor arm having a proximal portion to extend between the second feed leg and the second end of the loop conductor, and having a distal portion to extend outwardly from the second feed leg;

the first conductor arm and the proximal portion of the second conductor arm defining a slotted opening into an interior of the loop conductor.

17. The method according to claim 16, wherein the second conductor arm has an elongated linear shape.

18. The method according to claim 16, wherein the second conductor arm has an L-shape.

19. The method according to claim 16, wherein the second conductor has U-shape.

20. The method according to claim 16, wherein the second conductor defines a second slotted opening between the loop conductor and the second conductor arm.

21. The method according to claim 16, wherein the first conductor arm has an elongated linear shape.

22. The method according to claim 16, wherein the loop conductor has a U-shape.

23. The method according to claim 16, wherein the PCB comprises a ground plane conductor.

* * * * *

UNITED STATES PATENT AND TRADEMARK OFFICE

CERTIFICATE OF CORRECTION

PATENT NO. : 8,497,806 B2
APPLICATION NO. : 13/005326
DATED : July 30, 2013
INVENTOR(S) : Lai et al.

It is certified that error appears in the above-identified patent and that said Letters Patent is hereby corrected as shown below:

On the title page, item (75), Delete: "(75) Inventors: Chun Kit Lai, Sunrise, FL (US); Soo Liam Ool, Sunrise, FL (US); Qiwu Tan, Sunrise, FL (US)"
Insert: -- (75) Inventors: Chun Kit Lai, Sunrise, FL (US); Soo Liam Ooi, Sunrise, FL (US); Qiwu Tan, Sunrise, FL (US)" --

Signed and Sealed this
First Day of October, 2013

Teresa Stanek Rea
*Deputy Director of the United States Patent and Trademark Office*